US007346300B2

(12) United States Patent
Inami et al.

(10) Patent No.: US 7,346,300 B2
(45) Date of Patent: Mar. 18, 2008

(54) DEVELOPING APPARATUS

(75) Inventors: Satoru Inami, Numazu (JP); Daisuke Baba, Mishima (JP); Masahito Kato, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 317 days.

(21) Appl. No.: 11/242,880

(22) Filed: Oct. 5, 2005

(65) Prior Publication Data

US 2006/0078356 A1 Apr. 13, 2006

(30) Foreign Application Priority Data

Oct. 8, 2004 (JP) ..... 2004-296756

(51) Int. Cl.
*G03G 15/09* (2006.01)

(52) U.S. Cl. ..... 399/274; 399/284; 399/286

(58) Field of Classification Search ..... 399/107, 399/119, 252, 265, 274, 284, 286, 350
See application file for complete search history.

(56) References Cited

U.S. PATENT DOCUMENTS

| | | | | |
|---|---|---|---|---|
| 5,177,537 | A | 1/1993 | Okano et al. | 355/259 |
| 5,721,433 | A | 2/1998 | Kosaka | 250/573 |
| 7,209,699 | B2 * | 4/2007 | Yamaguchi et al. | 399/346 |
| 2004/0223789 | A1 | 11/2004 | Inami et al. | 399/252 |

FOREIGN PATENT DOCUMENTS

| | | |
|---|---|---|
| JP | 3-191370 | 8/1991 |
| JP | 8-136439 | 5/1996 |
| JP | 8-211728 | 8/1996 |
| JP | 11-119551 | 4/1999 |
| JP | 2002-278262 | 9/2002 |

* cited by examiner

*Primary Examiner*—Hoan Tran
(74) *Attorney, Agent, or Firm*—Fitzpatrick, Cella, Harper & Scinto

(57) ABSTRACT

A developing apparatus having a developer carrying member carrying developer including toner, a developer regulating member regulating the layer thickness of the developer carried on the developer carrying member, and a lubricant provided in a contact portion between the carrying member and the regulating member with the developer being not present on the carrying member, wherein the lubricant includes a first polymer particle which is of a spherical shape having an average degree of circularity of 0.90 or greater and is of a polarity opposite to the charging polarity of the toner, and a second polymer particle of a scalelike shape and of the same polarity as the charging polarity of the toner.

6 Claims, 5 Drawing Sheets

DEVELOPING APPARATUS

BACKGROUND OF THE INVENTION

1. Field of the Invention

The invention relates to a developing apparatus usable in an image forming apparatus such as a copying machine, a printer or a facsimile apparatus.

2. Description of the Related Art

An image forming apparatus adopting a conventional electrophotographic printing method will first be described with reference to FIG. 4 of the accompanying drawings.

As shown in FIG. 4 of the accompanying drawings, a popular image forming apparatus comprises a photosensitive member 101 as a rotatable latent image bearing member, a charging device 102 driven to rotate by the photosensitive member 101 for charging the photosensitive member 101 to predetermined potential, an exposing device 103 for forming an electrostatic latent image on the photosensitive member 101, a developing apparatus 104 for developing and visualizing the electrostatic latent image on the photosensitive member 101, a transferring device 105 for transferring the visible image on the photosensitive member 101 to a sheet, a fixing device 108 for fixing the visible image as a permanent image, and a cleaning device 106 for collecting any developer not transferred to the sheet but residual on the photosensitive member 101.

In recent years, there has been provided an image forming apparatus in which among these, the photosensitive member 101, the charging device 102, the developing apparatus 104 and the cleaning device 106 are integrally incorporated and made into a process cartridge detachably mountable on an image forming apparatus main body, whereby which is free of the necessity of maintenance and excellent in usability.

When the image forming apparatus shown in FIG. 4 is to be manufactured, in the step of assembling the developing apparatus comprised of at least the developer (hereinafter referred to as the toner) 111, a developer carrying member (hereinafter referred to as the developing sleeve) 110 carrying the toner 111 thereon, and a developer regulating member (hereinafter referred to as the developing blade) 109 for regulating a toner coating on the developing sleeve 110, it is generally practised to rotate the developing sleeve 110 for a predetermined time with the developing sleeve 110 not coated with the toner, with a view to effect the check-up of the quality such as appearance inspection.

At this time, however, it is feared that friction injuries are formed on the developing blade 109 and the developing sleeve 110, or if the developing blade 109 is formed of an elastic material such as urethane rubber, the developing blade 109 will be turned up in the rotation direction of the developing sleeve 110 by the frictional resistance between the developing blade 109 and the developing sleeve 110.

When such a product is put on the market and the use thereof by the use of the toner 111 is actually started, there is the possibility of uniform and good toner coating being not done on the developing sleeve 110.

In order to solve this problem, it is practised to apply a lubricant on that side of the developing blade 109 which abuts against the developing sleeve 110 when at the assembling step, the developing sleeve 110 is rotated for the predetermined time with the developing sleeve not coated with the toner 111.

The lubricant used at this time is related to the developing characteristic and the occurrence of development streaks at the initial stage whereat the developing sleeve 110 has been coated with the toner 111 and the developing apparatus has begun to be actually used and therefore, a lubricant having a proper charging characteristic, shape, etc. is selected and used.

For example, in Japanese Patent Application Laid-open No. H8-211728, there is proposed a method of applying spherical silicone resin particles having an average particle diameter of 5-30 μm in the form of a powder material onto the developing sleeve, and in Japanese Patent Application Laid-open No. H11-119551, there is proposed a method of applying resin particles having an average particle diameter of 5-45 μm and having a proper charge amount (spherical PMMA (polymethyl methacrylate), urethane, acryl, polystyrene or PVDF (polyvinylidene fluoride)), or amorphous silicone resin particles.

Also, recently, in Japanese Patent Application Laid-open No. 2002-278262, there has been done the proposition to adopt spherical polymer particles having an average degree of circularity of 0.90 or greater, and in which the application amount of lubricant in a longitudinal direction existing on a developer regulating member and a developer carrying member is 0.23-1.4 mg/cm, and of which the weight average particle diameter is greater than the surface roughness Rz of the developer carrying member.

Now, in a new (unused) developing apparatus, the toner in a developer container has charges not imparted thereto and therefore, even if charges are imparted by that portion of the developing blade which abuts against the developing sleeve, it is difficult for the proper charges of the toner to be immediately reached. Consequently, at the stage of beginning to use, a sufficient developing property is sometimes not obtained and density is low, or characters become thin.

Further, a ghost phenomenon due to the deficiency of charges imparted to the toner also appears.

The ghost phenomenon in this case is such that as shown in FIG. 5, the residual image of an image before one revolution of the developing sleeve 110 appears as a ghost image.

Particularly at the early stage of the use of the developing apparatus, if the regular charging polarity of the toner is the negative polarity, the negative ghost that the image becomes dark in the first one revolution of the developing sleeve and becomes light in the second and subsequent revolutions. This is because the toner on the developing sleeve after the toner has been used for development cannot immediately a proper charge amount and a proper coat amount and therefore, the developing property in the second and subsequent revolutions lowers and the negative ghost occurs.

Against this problem, the charging characteristic of the toner itself can be raised so that proper toner charges may be obtained, and the developing property can be set to a high level from the early stage of the use of the developing apparatus, but at the later stage (the latter half) of the use of the developing apparatus whereat the toner reaches the end of its life, a reduction in density often caused conversely by the excessive charge imparting of the toner.

There is also means for detecting only the early stage of the use of the developing apparatus and changing the setting of the developing bias of the image forming apparatus main body to a side for enhancing the developing property to thereby heighten the density, but by this means, it is impossible to eliminate the density difference between the first one revolution and the second and subsequent revolutions of the developing sleeve, and the effect for the ghost phenomenon is small.

Here, it has been found by the inventor's diligent study that the proposition of Japanese Patent Application Laid-open No. H3-191370 to provide a particle layer chargeable in a polarity opposite to a polarity of the developer to give the charge imparting effect of the developer is also effective to mitigate the negative ghost. This means was very effective against the negative ghost, but it has been found by the inventor's repeated study that when a toner having relatively high chargeability is used, a faulty image such as white haze or a longitudinal streak may occur.

In the toner having relatively high chargeability, if use is made of a lubricant consisting of only polymer particles of the opposite polarity, when the charge amount difference of the toner between a portion in which the toner and spherical polymer particles of the opposite polarity strongly contact with each other and a portion in which they weakly contact with each other or are in non-contact with each other becomes great and becomes non-uniform, development is effected in conformity with the chargeability and an uneven image or a hazy image is formed.

SUMMARY OF THE INVENTION

It is an object of the present invention to provide a developing apparatus in which the chargeability of a toner is uniformized.

It is another object of the present invention to provide a developing apparatus which is free of a faulty image.

It is another object of the present invention to provide a developing apparatus in which uneven density is prevented.

It is another object of the present invention to provide a developing apparatus in which a ghost image is prevented.

It is another object of the present invention to provide a developing apparatus of which the developing characteristic can be stabilized during the early stage of the use to the later stage of the use of the developing apparatus.

Further objects and features of the present invention will become more apparent from the following detailed description when read with reference to the accompanying drawings.

DESCRIPTION OF THE PREFERRED EMBODIMENTS

The best embodiments for carrying out the present invention will hereinafter be described by way of example with reference to the drawings. However, the dimensions, materials, shapes, relative arrangement, etc. of constituent parts described in these embodiments should be suitably changed depending on the construction and various conditions of an apparatus to which the present invention is applied, and the scope of this invention is not intended to be restricted to the following embodiments.

Embodiment 1

Embodiment 1 of the present invention will hereinafter be described with reference to the drawings.

Figure 1:
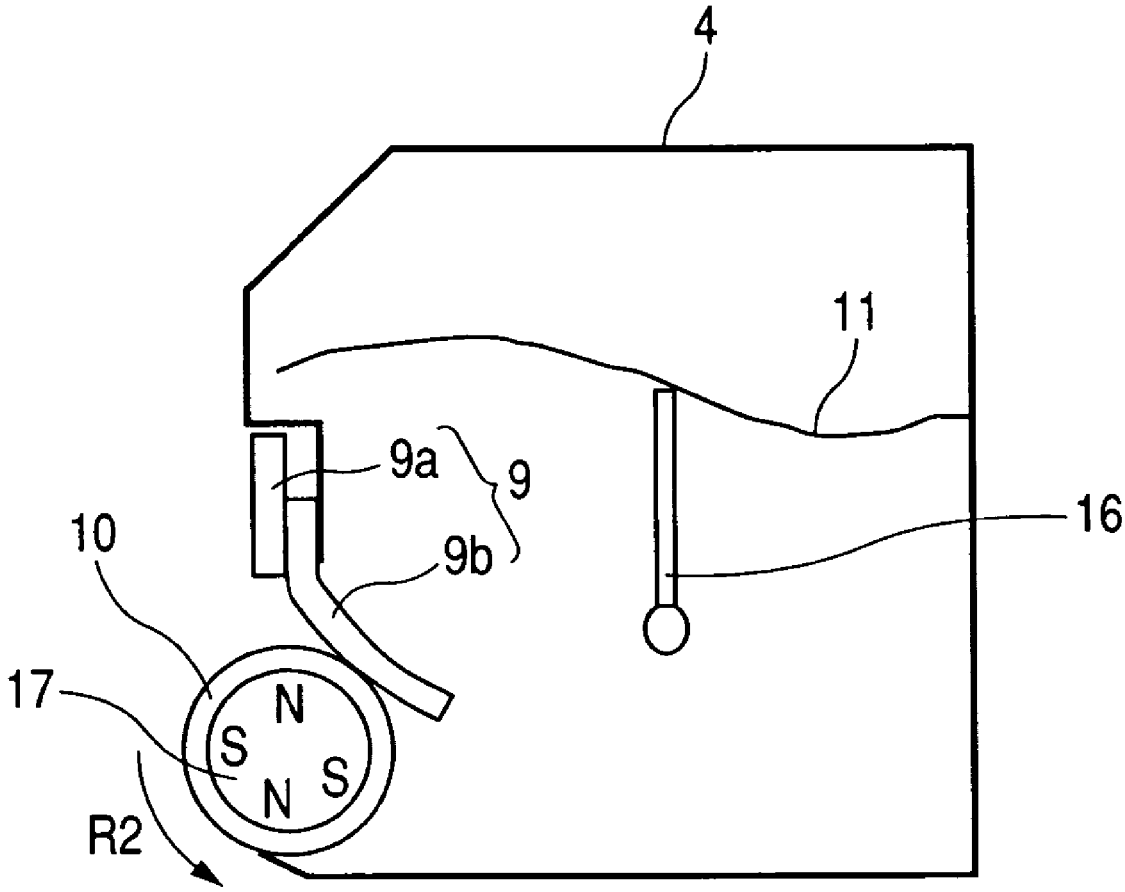
FIG. 1 is a schematic view showing an example of a developing apparatus according to an embodiment of the present invention.
Figure 2:
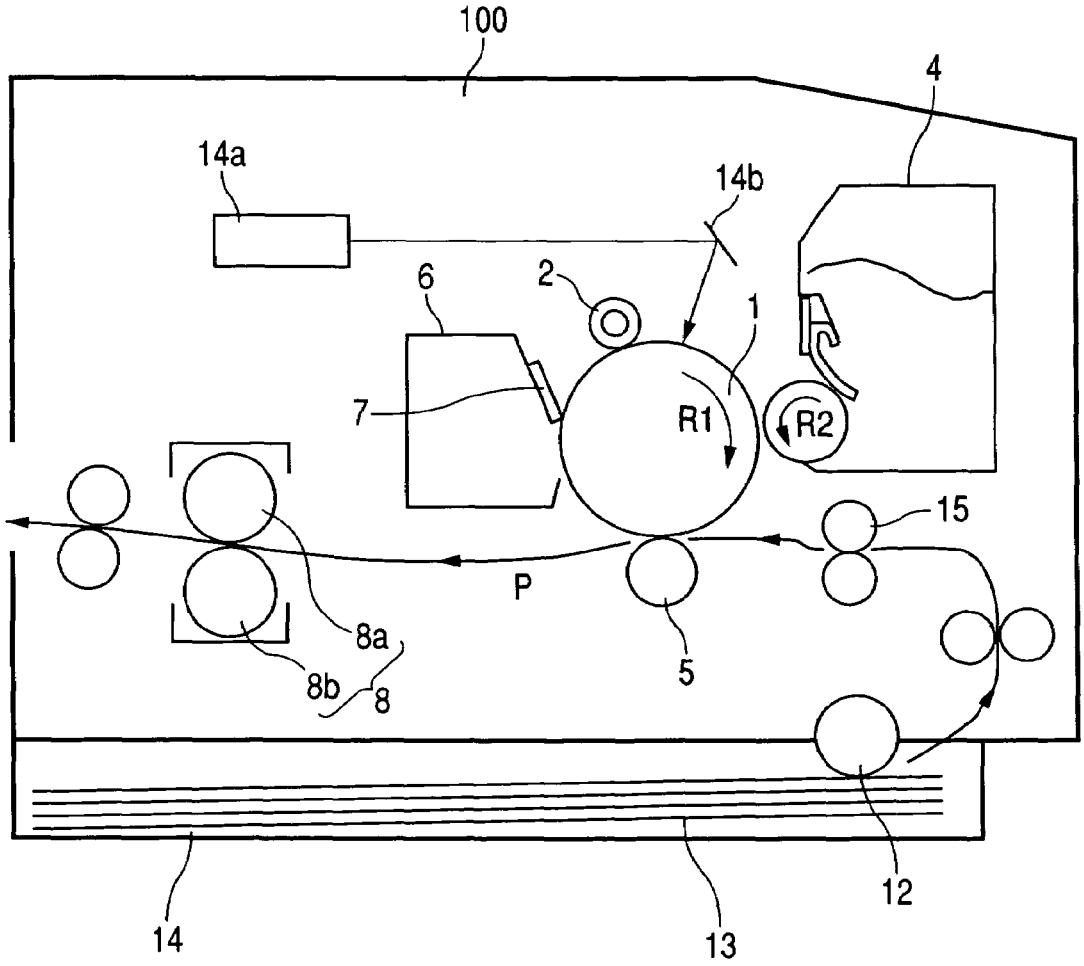
FIG. 2 is a schematic view showing an example of an image forming apparatus according to an embodiment of the present invention.

FIG. 1 shows an example of a developing apparatus according to Embodiment 1 of the present invention. FIG. 1 is a longitudinal cross-sectional view schematically showing the construction of the developing apparatus. FIG. 2 shows an example of an image forming apparatus according to the present embodiment provided with this developing apparatus. FIG. 2 is a longitudinal cross-sectional view schematically showing the construction of the image forming apparatus.

Reference is first made to FIG. 2 to describe the entire image forming apparatus, and then reference is made to FIG. 1 to describe the developing apparatus.

The image forming apparatus shown in FIG. 2 is provided with an image forming apparatus main body (hereinafter referred to as the apparatus main body) 100 as a printer engine.

A drum-shaped electrophotographic photosensitive member (hereinafter referred to as the "photosensitive drum") 1 as an image bearing member is provided inside the apparatus main body 100. The photosensitive drum 1 is rotatively driven at a predetermined process speed (peripheral speed) in the direction indicated by the arrow R1 in FIG. 2 about an axis by a driving force being transmitted thereto.

The photosensitive drum 1 has its surface charged by a charging roller 2 as a charging device. The charging roller 2 is disposed in contact with the surface of the photosensitive drum 1, and is driven to rotate by the rotation of the photosensitive drum 1 in the direction indicated by the arrow R1. A charging bias comprising, for example, an AC voltage and a DC voltage superimposed one upon the other is applied to the charging roller 2 by a charging bias applying power supply (not shown). Thereby, the surface of the photosensitive drum 1 is uniformly charged to a predetermined polarity and predetermined potential.

An electrostatic latent image is formed on the surface of the photosensitive drum 1 after charged, by an exposing device. The exposing device has a laser scanner 14*a*, a polygon mirror (not shown), a reflecting lens 14*b*, etc., and applies a laser beam based on image information to the surface of the photosensitive drum 1 to thereby eliminate the charges of the irradiated portion and form the electrostatic latent image.

The electrostatic latent image thus formed on the surface of the photosensitive drum 1 has a toner as a developer made to adhere thereto, and is developed as a toner image. The developing apparatus 4 will be described later in detail.

The toner image formed on the surface of the photosensitive drum 1 is transferred onto a sheet 13 by a transfer roller 5 as a transferring device. This sheet 13 has been contained in a sheet supplying cassette 14 and has been supplied to a transfer nip portion in the direction indicated by the arrow P in synchronism with the toner on the photosensitive drum 1 by a sheet feeding roller 12 and registration rollers 15. A transferring bias opposite in polarity to the toner image on the photosensitive drum 1 is applied to the transfer roller 5 by a transferring bias applying power supply (not shown), whereby the toner image on the photosensitive drum 1 is transferred onto the sheet 13.

The photosensitive drum 1 has toner residual on its surface after the transfer of the toner image to the sheet 13 removed by the cleaning blade 7 of a cleaning device 6, and is used for the next image formation.

On the other hand, the sheet 13 after the transfer of the toner image is conveyed to a fixing device 8, and is heated and pressurized by a fixing roller 8*a* and a pressure roller 8*b*, whereby the toner image on the surface thereof is fixed. The sheet 13 after the fixing of the toner image is discharged to the outside of the apparatus main body 100, whereby image formation is completed.

In FIG. 1, the photosensitive member, the charging device, the developing apparatus and the cleaning device are integrally provided in a process cartridge, which is detachably mountably in the image forming apparatus main body. It is preferable that the process cartridge be provided with at least the photosensitive member and the developing apparatus. Also, the developing apparatus simplex can be made detachably mountable on the image forming apparatus main body.

The developing apparatus 4 according to the present embodiment will now be described in detail with reference chiefly to FIG. 1.

The developing apparatus 4 shown in FIG. 1 is a developing apparatus using a magnetic toner which is a one-component developer, and comprises chiefly an agitating member 16 containing the toner 11 therein, and loosening and carrying the toner 11, a developing sleeve 10 as a developer carrying member for charging the carried toner and using the toner for development, and a developing blade 9 as a developer regulating member.

The developing sleeve 10 is a nonmagnetic sleeve formed by a pipe of aluminum or stainless steel, and is supported by the developing apparatus 4 for rotation in the direction indicated by the arrow R2. In the present embodiment, a hollow cylindrical tube of aluminum having a diameter of 16.0 mm is used as the developing sleeve 10. The developing sleeve 10 has runners (not shown) larger in diameter than the developing sleeve 10 fixed to its longitudinal (axial) opposite end portions, and is adapted to secure a predetermined gap between the developing sleeve 10 and the surface of the photosensitive drum 1 by these runners being brought into contact with the photosensitive drum 1.

Also, a magnet 17 is disposed inside the developing sleeve 10. The magnet 17 is formed into a cylindrical shape, and has a plurality of N poles and S poles alternately formed in the circumferential direction thereof. The magnet 17, unlike the developing sleeve 10 which is rotated in the direction indicated by the arrow R2, is fixedly disposed against rotation inside the developing sleeve 10.

The developing blade 9 abuts against the surface of the above-described developing sleeve 10. The developing blade 9 is provided with an elastic blade 9*b* pressed against the developing sleeve 10, and a supporting metal plate 9*a* supporting the elastic blade 9*b*. The elastic blade 9*b* is constituted by urethane rubber formed into a plate shape, and is elastically deformed with its base end portion fixed to the supporting metal plate 9*a*, and its distal end brought into contact with the surface of the developing sleeve 10 with predetermined pressure. The elastic blade 9*b* serves to regulate the layer thickness of the toner attracted to the surface of the developing sleeve 10 by the magnetic force of the above-described magnet 17. In the present embodiment, the thickness of the elastic blade 9*b* is t=1.0 mm, and the pressure of contact thereof with the developing sleeve 10 is set to 19.6 N/m in terms of line pressure in the longitudinal direction of the sleeve.

The toner carried on the surface of the developing sleeve 10 has imparted thereto appropriate charges by triboelectrification between toner particles by being carried by the rotation of the developing sleeve 10 in the direction indicated by the arrow R2, and triboelectrification by frictional contact between the developing sleeve 10 and the elastic blade 9*b* when the layer thickness is regulated by the developing blade 9, and further is carried to a developing area opposed to the surface of the photosensitive drum 1.

At this time, a developing bias comprising an AC voltage and a DC voltage superimposed one upon the other is applied to the developing sleeve 10 by an AC developing bias applying power supply and a DC developing bias applying power supply through a point of frictional contact (not shown). The peak-to-peak voltage of the AC voltage is set so as to cross both of the dark portion potential and light portion potential of the electrostatic latent image. Thereby, the toner on the developing sleeve 10 flies to the photosensitive drum 1 in the developing area and electrostatically adheres to the electrostatic latent image, whereby the electrostatic latent image is developed as a toner image.

The developing blade 9 has applied thereto a lubricant in the following manner at at least a location (contact portion) whereat the elastic blade 9*b* abuts against the developing sleeve 10, with the developing sleeve 10 not coated with the toner at the assembling stage of the developing apparatus 4. The location to which the lubricant is applied is not restricted to that described above, but can be a location of the developing sleeve 10 against which at least the elastic blade 9*b* abuts. As described above, the lubricant is provided on the portion of contact between the developing sleeve 10 and the developing blade 9 with no developer present on the developing sleeve 10. Also, in a new developing apparatus, in order to bring about a state in which no developer is present on the developing sleeve 10 before the use thereof, it is preferable that the developing apparatus be comprised of a developing container in which the developing sleeve 10 is provided, and a developer container containing the developer therein in advance, and a seal member for sealing the developer in the developer container in the state before the use of the developing apparatus be provided between the developing container and the developer container. When the developing apparatus is used, the seal member can be removed so that the developer in the developer container may be carried into the developing container.

In the present embodiment, plural kinds of polymer particles are mixed together as the lubricant. So, as means for obtaining uniform dispersion for the lubricant, description will hereinafter be made of a method of applying a lubricant having polymer particles dispersed therein by a solvent.

Figure 3:
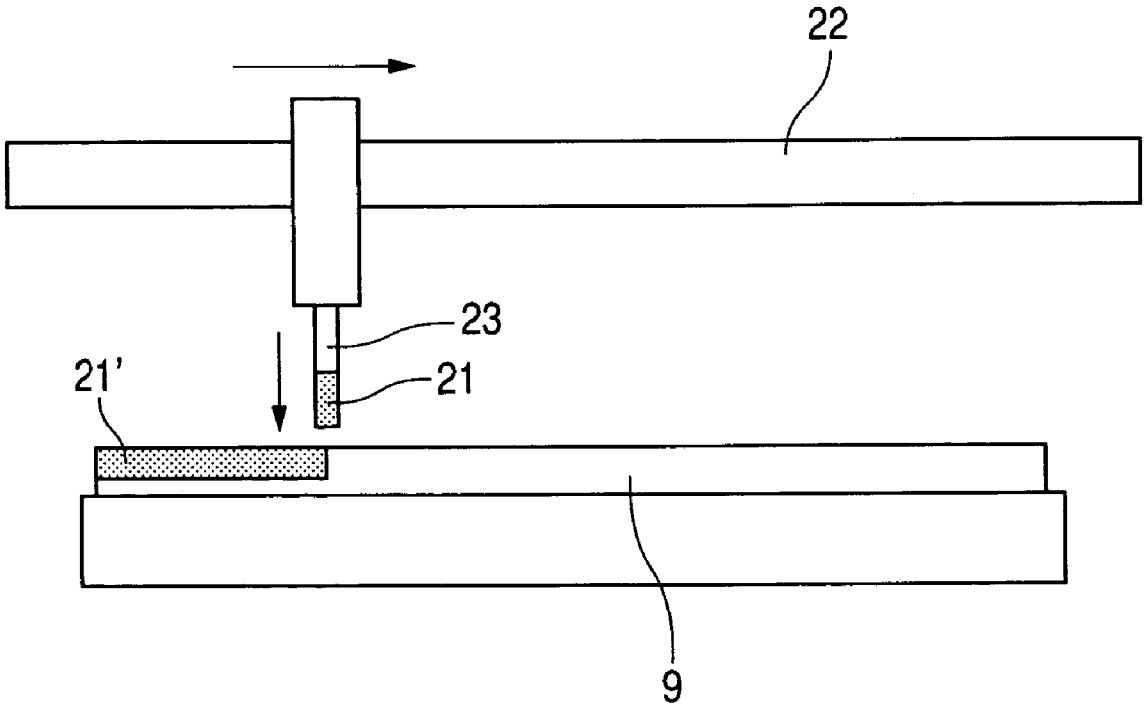
FIG. 3 is a view for illustrating a method of applying a lubricant to a developing blade according to an embodiment of the present invention.
Figure 4:
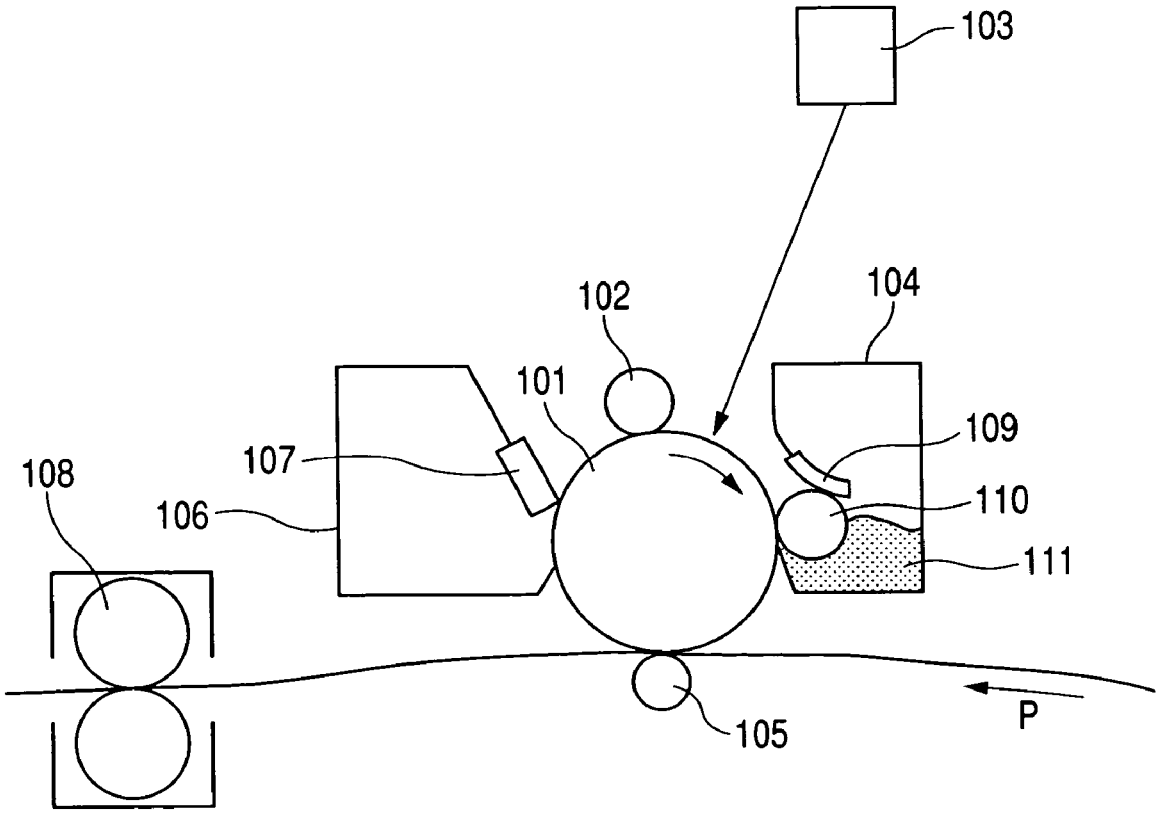
FIG. 4 is a schematic view showing a conventional image forming apparatus.
Figure 5:
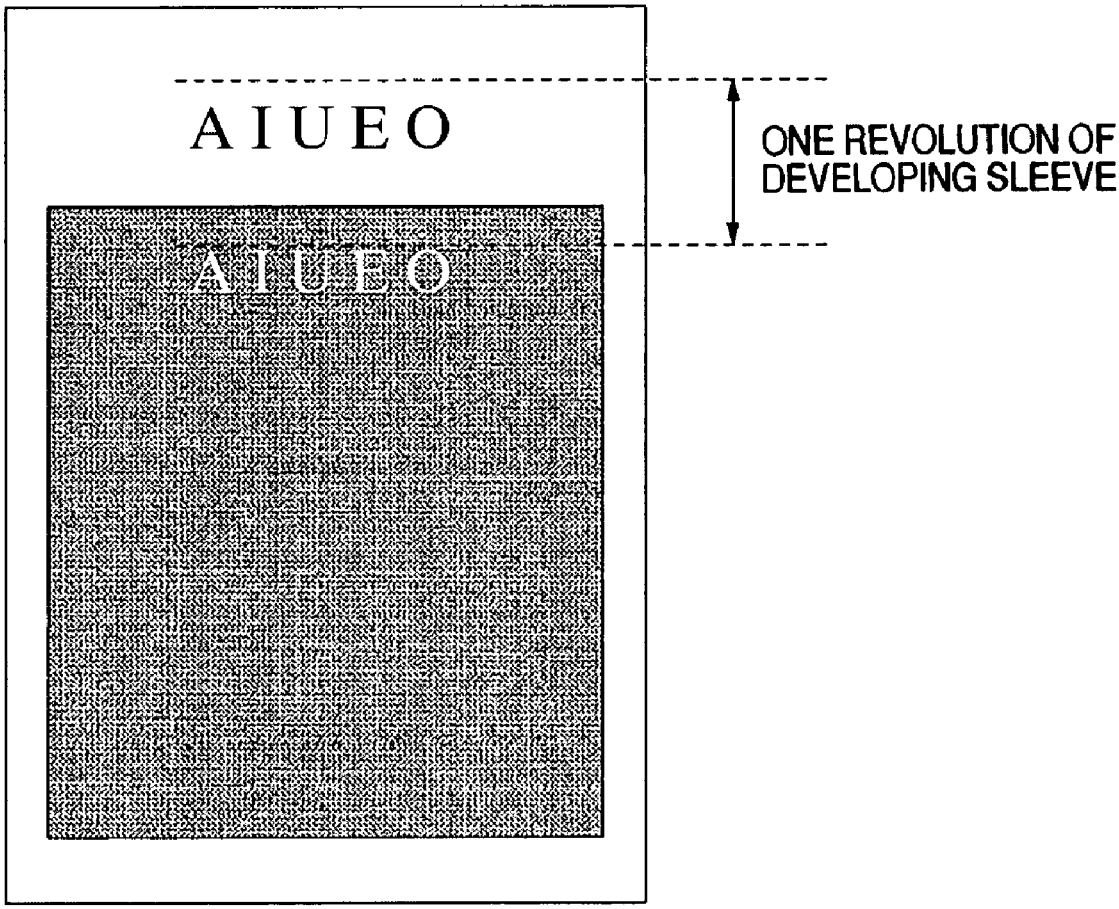
FIG. 5 is a view for illustrating a negative ghost.

FIG. 3 is a view for illustrating a method of applying the lubricant to the developing blade.

The lubricant is applied to a portion of the surface of the elastic blade 9*b* (the upper side of the blade 9 as viewed in FIG. 3) in the manner as shown in FIG. 3. First, the lubricant (a mixture of plural kinds of polymer particles) is dispersed in and mixed with a volatile solvent at a mass ratio of (lubricant):(PF5060):(IPE)=2.5:4:11, where PF5060 is Fluorinert™, and IPE is isopropylether.

In the present embodiment, a plurality of polymer particles differing in shape and polarity from one another are mixed together and therefore, the lubricant is liable to condense and become non-uniform. It cannot be uniformly dispersed only by low-speed agitating means like an ordinary stirrer, and when the lubricant was applied in that state and image evaluation was effected, scalelike white haze and black haze images non-uniform in charging occurred.

Therefore, to extract the effect of the lubricant in the present embodiment, it is necessary to disperse it uniformly in advance, and in the present embodiment, agitation was effected at 15,000 rpm for 5 minutes by a powerful dispersion processor like a homogenizer (produced by IKA, Ltd., trade name: Ultra-Turrax). It has been found that when the lubricant is thus once dispersed by a power disperser, only the agitation by a stirrer suffices thereafter.

Next, as shown in FIG. 3, a lubricant-containing solution 21 in a container prepared in the manner described above is sucked by the nozzle 23 of a vertically and horizontally movable applying machine 22. The developing blade 9 is fixedly disposed in advance, and the nozzle 23 is moved to an application starting position. From that position to an application ending position, the nozzle 23 is moved while the solution 21 is discharged therefrom, to thereby effect application (the reference character 21' in FIG. 3 denotes the portion to which the lubricant has been applied).

Also, during the application of the lubricant, the plurality of polymer particles used are liable to condense and therefore, during the application, it is effective to disperse the solution uniformly at all times by agitating means of low speed (100-1,000 rpm) like a stirrer.

The above-mentioned ratio of the solution 21 contained spherical polymer particles is an example, and it is possible to change the density of the polymer particles in the mixed solution to thereby suitably adjust the application amount of the lubricant, and if the application amount of the lubricant after the volatilization of the solvent is within a range of 1.5-15 g/m$^2$, it is effective for density and negative ghost, and the feared uneven density does not occur.

Since the lubricant can be uniformly applied to the developing blade 9 by the above-described method, that portion of the developing sleeve 10 incorporated thereafter which contacts with the developing blade 9 is also longitudinally uniformly coated.

Here, description will be made of the shape of the polymer particles of the lubricant in the present embodiment, and the definition of the average particle diameter.

<Shape>

The degree of circularity of the particle in the present embodiment is used as a simple method of quantitatively expressing the shape of the particle, and in the present embodiment, measurement is effected by the use of a flow type particle image analyzing apparatus FPIA-1000 produced by Toa Medical Electronics Co., Ltd., and the degree of circularity of the measured particle is found by the following expression (1).

$$\text{Degree of circularity } a = L_0/L \quad (1)$$

[In the above expression, $L_0$ indicates the circumferential length of a circle having the same projection area as a particle image, and L indicates the circumferential length of the particle image.]

In the present embodiment, the degree of circularity "a" is the index of the degree of unevenness of the surface of the toner particle, and exhibits 1.000 when the toner is a complete sphere, and the more complicated becomes the surface shape, the smaller value the degree of circularity assumes.

As a specific measuring method by "FPIA-1000" which is the measuring apparatus used in the present embodiment, 0.1-0.5 ml of interfacial active agent, preferably alkyl benzene sulfonic acid salt, as a dispersing agent, is added to 100-150 ml of water in a container from which impurities have been removed in advance, and about 0.1-0.5 g of measurement sample is further added thereto. An ultrasonic wave (50 kHz, 120 W) is applied to a suspension having a sample dispersed therein for 1 to 3 minutes, and with the dispersion liquid density as 12,000-20,000 particles/μl, the distribution of the degree of circularity of a particle having a diameter corresponding to a circle of 0.60 μm or greater and 159.21 μm or less is measured by the use of the above-mentioned flow-type particle image measuring apparatus. By the dispersion liquid density being 12,000-20,000 particles/μl, particle density enough to keep the accuracy of the apparatus can be maintained.

The epitome of the measurement is described in the catalog (June 1995 edition) of FPIA-1000 published by Toa Medical Electronics, Ltd., an operation manual for the measuring apparatus and Japanese Patent Application Laid-open No. H8-136439, and is as follows.

The sample-dispersed liquid is passed through a flow path (spread along a flow direction) of a flat flow cell (having a thickness of about 200 μm). A stroboscopic lamp and a CCD camera are mounted so as to be located on opposite sides relative to the flow cell so as to form an optical path crossing and passing through the thickness of the flow cell. During the time when the sample-dispersed liquid is flowing, stroboscopic light is applied at intervals of 1/30 sec. to obtain the image of particles flowing through the flow cell, and as the result, each particle is photographed as a two-dimensional image having a predetermined range parallel to the flow cell. From the area of the two-dimensional image of each particle, the diameter of a circle having the same area is calculated as a radius corresponding to a circle. The degree of circularity of each particle is calculated from the projection area of the two-dimensional image of each particle and the circumferential length of the projected image by the use of the above-mentioned expression for calculating the degree of circularity.

<Weight Average Particle Diameter>

The weight average particle diameter of the polymer particles, when the total weight of particles of which the diameter corresponding to a circle is within a range of di to di+1 is defined as fi, is defined as:

$$\text{the weight average particle diameter} = \Sigma(di \times fi)/\Sigma fi.$$

The above-mentioned parameters are all the values measured by the use of the flow particle image analyzing apparatus FPIA-1000 produced by Toa Medical Electronics, Ltd.

In the present embodiment, as the developer, use is made of a magnetic one-component styrene negative toner having a weight average particle diameter of 7 μm with particles of silica or the like extraneously added thereto.

As regards the developing sleeve 10, in order that proper charges may be given when it bears a desired amount of toner on its surface, phenol resin is coated with a solvent containing carbon and a charge controlling agent by a spray coating method.

About the lubricant in the present embodiment, the following experiment was carried out by the developing apparatus 4 of the above-described construction.

As the developing apparatus 4, use was made of an apparatus capable of passing 6,000 sheets of A4 size at a coverage rate of 5%, and the experiment was carried out by continuous sheet passing under an environment of 15° C. in which ghost is liable to be conspicuous. As an image outputted onto a sheet, a character and a black pattern of 25 mm square were constituted on the leading edge portion of the sheet, and a pattern which was a halftone of about 40% dot percentage was constituted on that portion of the sheet corresponding to one revolution of the developing sleeve from after the leading edge portion of the sheet. Then, comparison was made by the manner in which a ghost image occurring in the halftone was conspicuous.

The judgment standard was based on four stages, i.e., X: very conspicuous; Δ: the extent that both the character and the black pattern of 25 mm square are inconspicuous; ○: the character is illegible; ◎: both the character and the black pattern of 25 mm square are illegible.

Also, about white haze and longitudinal streaks due to the uneven charging of the toner occurring at this time, the presence or absence thereof was checked up.

The judgment standard is at three stages, i.e., X: occurred; Δ: occurred only at the early stage and only in a portion of an image; ○: not occurred.

Table 1 below shows the result of the experiment.

TABLE 1

| | spherical polymer particles lower stage: particle diameter | | amorphous polymer particles lower particle stage: diameter | mixing ratio (weight ratio) | | white haze/ longitudinal |
|---|---|---|---|---|---|---|
| | (A) | (B) | (C) | (A):(B):(C) | ghost | streak |
| (a) | PMMA 1.5 μm | — | silicone resin 12 μm | 1:0:1-1:0:3 | Δ | Δ |
| (b) | melamine 0.1 μm | — | silicone resin 12 μm | | ○ | ○ |
| (c) | melamine 0.1 μm | — | graphite fluoride 1 2 μm | 1:0:7-1:0:12 | ○ | ○ |
| (d) | melamine 2 μm | — | graphite fluoride 1 2 μm | 5:0:2-5:0:5 | ○ | Δ |
| (e) | melamine 0.1 μm | — | graphite fluoride 2 2 μm | 1:0:40-1:0:200 | ◎ | ○ |
| (f) | melamine 0.1 μm | melamine 2 μm | graphite fluoride 1 2 μm | 1:20:12-5:20:12 | ◎ | ○ |
| (g) | melamine 0.1 μm | strontium titanate 1 μm | graphite fluoride 1 2 μm | 1:1:5-1:1:12 | ○ | ○ |
| Comparative Example 1 (h) | silicone resin 12 μm | — | — | — | X | ○ |
| Comparative Example 2 (i) | melamine 0.1 μm | — | — | — | ◎ | X |
| Comparative Example 3 (j) | melamine 0.1 μm | silicone resin 12 μm | — | — | ○ | X |

The combination of the plurality of polymer particles of the lubricant in the present embodiment and the result thereof are as shown in (a) to (g) in Table 1. As to the polarity of the polymer particles to the toner, the toner or the polymer particles were mixed with an iron powder carrier and the charge amount of the mixture was measured by the blow-off method, and the +(plus) side or −(minus) side polarity to the charging polarity of the toner was judged.

As the spherical polymer particles (first type polymer particles) in the present embodiment, use was made of polymer particles having a degree of circularity of about 0.98 and having the +(plus) side polarity opposite to the charging polarity of the toner. Also, the amorphous polymer particles (second type polymer particles) are of a scalelike shape and the charging polarity thereof is the −(minus) side. Here, the scalelike shape refers to a thin plate-like shape like a scale. Its plane shape may be a circle, an elliptical shape, a square shape, an amorphous shape or the like, and is not particularly restricted. The amorphous shape means that the shape of polymer particles is not uniform but various.

In Table 1, the graphite fluoride 1 of the amorphous polymer particles under Examples (c), (d), (f) and (g) has fluorine content of 60-70% and volume resistance of the order of $10^{10}$ Ω·cm, and the graphite fluoride 2 in Example (e) has fluorine content of 30-35% and volume resistance of the order of $10^{6}$ Ω·cm, and the resistance thereof is rather low.

Example (f) is a mixture of three kinds of polymer particles, and as the spherical polymer particles, use was made of two kinds of melamine resin particles having different weight average particle diameters, and as the amorphous polymer particles, use was made of graphite fluoride particles.

Example (g) also is a mixture of three kinds of polymer particles, and as the spherical polymer particles, use was made of melamine resin particles and strontium titanate particles which are weakly positive, and as the amorphous polymer particles, use was made of graphite fluoride particles.

As comparative examples, mention is made of a case (h) where the polymer particles are only silicone resin particles of which the charging polarity is the −(minus) side, a case (i) where the polymer particles are only melamine resin particles, and a case (j) where as the comparison of Example (b), use was made of melamine resin particles and spherical silicone resin particles.

Ghost was very conspicuous in the case of only the silicone resin particles in Example (h), and in the case of Example (i), ghost was at a level, which posed no problem, but white haze and longitudinal streaks occurred at the early stage of the use.

In Comparative Example (j), the shape difference from item (b) was checked up by the use of spherical particles instead of the amorphous particles of silicone resin in Example (b). By the silicone resin particles having become spherical, a similar effect was obtained for the ghost phenomenon, but white haze/longitudinal streaks came to occur in a portion of an image, and it has been found that for this phenomenon, the scalelike indefinite shape is an important factor.

In contrast with these, in Examples (a) to (g), it has been verified that ghost is inconspicuous and the problems of white haze and longitudinal streaks do not arise.

When among these, Examples (c) and (d) were compared with each other, it has been found that being in the relation that (weight average particle diameter of spherical polymers)<(weight average particle diameter of amorphous polymers) provides an area in which ghost, white haze and longitudinal streaks do not occur, and when the effect with the mixing ratio changed was checked up, latitude is wide.

It is preferable for the mitigation of negative ghost that the weight average particle diameter of the spherical polymer particles be 0.01 to 3 μm, and the weight average particle diameter of the amorphous polymer particles which was effective to mitigate the ghost and could suppress white haze and longitudinal streaks was preferably 1-6 μm.

The reason why the upper limit of the weight average particle diameter of the amorphous polymer particles is 6 μm is that if the amorphous polymer particles assume a size equal to or larger than the weight average particle diameter of the toner, it may affect the charging itself of the toner or the effect as the lubricant may become small.

Also, it has been found that as in Example (e), the resistance of the amorphous polymer particles is made low, whereby it becomes easy to make the positive charging of the spherical particles low and uniform and therefore, it becomes easy to adjust the chargeability, and it is possible to secure a wide range of percentage of polymer particles which do not cause ghost, white haze and longitudinal streaks. From the result of my detailed study, it has been found that the effect of the present embodiment can be obtained even by an insulator of the order of $10^{10}$ Ω·cm as in Example (d), but as a range within which the latitude can be adjusted more widely with ease, it is preferable that the volume resistance of the amorphous polymer particles be medium resistance of $10^4$-$10^8$ Ω·cm.

Also, as regards Examples (f) and (g), weakly positive particles are mixed in a rather great deal to thereby weaken the positiveness of the spherical polymer particles (A), and a small amount of amorphous polymer particles can be combined to thereby adjust chargeability.

As described above, by using an agent in which two or more kinds of particles, i.e., spherical polymer particles of a polarity opposite to the charging polarity of the toner used, and amorphous polymer particles of the same polarity as the charging polarity of the toner are mixed together, it becomes possible to obtain not only the action as a lubricant, but also the action of imparting suitable charges for stabilizing the charges of the toner, and stabilize the developing characteristic.

As in the above-described embodiment, the chargeability of the entire lubricant could be properly adjusted by two or more kinds of polymer particles being mixed together.

While in the foregoing embodiment, description has been made of a case where a negative toner is used as the toner, also in a case where a positive toner is used, the same effect can be obtained by likewise selecting spherical polymer particles of the opposite polarity and amorphous polymer particles of the same polarity as the toner. In particular, it has been found that for the positive toner, fluorine resin particles are effective as spherical polymer particles, and titanium oxide, tin oxide or the like is effective as amorphous polymer particles.

As described above, by using a developing apparatus in which a lubricant in which two or more kinds of polymer particles such as spherical polymer particles of a polarity opposite to the polarity of the toner used and amorphous polymer particles of the same polarity as the toner are mixed together is applied to between the developing sleeve and the developing blade, it becomes possible to suppress negative ghost, white haze and longitudinal streaks liable to occur at the initial stage of the use of the developing apparatus.

Embodiment 2

Embodiment 2 of the present invention will hereinafter be described. An image forming apparatus according to this embodiment is similar in construction to the image forming apparatus according to Embodiment 1 described above, and need not be described.

In the present embodiment, description will be made of a combination of a toner having a high degree of circularity and a lubricant, and the inventor has confirmed as a result of his study that the higher is the degree of circularity of the toner, the more is obtained the effect of the present invention.

The toner having a high degree of circularity is a toner of which the weight average particle diameter X is 5-12 μm, and which has particles having a circle-corresponding diameter of 3 μm or greater and a degree of circularity of 0.900 or greater by 90% or more in terms of a cumulative value based on the particle number standard, and in which the relation between the particle number cumulative standard value Y of particles of which the degree of circularity is 0.950 or greater and the weight average particle diameter X of the toner satisfies $$Y \geqq (\exp 5.51) \times (X^{-0.645}) \quad (2)$$

where $5.0 < X \leqq 12.0$.

A toner having a high degree of circularity is more excellent in developing property than a toner of a distorted shape (a toner having a low degree of circularity such as a crushed toner), and makes the provision of an image forming apparatus of a high quality by being subjected to proper process control and therefore, is regarded as being promising in the future.

However, the toner of such a shape, as compared with the conventional toner of a distorted shape, has sometimes not reached predetermined charges simply by and tuboelectrification between the developing blade and the developing sleeve at the early stage of use whereat the toner has no charges, or because of its spherical shape, has sometimes become great in the difference of the coat density of the toner on the developing sleeve between the first revolution and the second revolution of the developing sleeve, thereby causing the occurrence of strong negative ghost.

In the present embodiment, as the typical examples of a negative toner of which the weight average particle diameter is 7 μm, check-up was done about a styrene resin toner A and a polyester resin toner B. In this case, the styrene resin toner A is higher in chargeability than the polyester resin toner B.

Table 2 and Table 3 below compared a case where the Y value is low (the degree of circularity is low) and a case where the Y value is high (the degree of circularity is high), in the toner A and the toner B, respectively, with each other.

The lubricants used in the experiment at this time are three kinds, i.e., the example (d) and comparative examples 1 and 2 in Table 1 described in Embodiment 1.

As in Embodiment 1, as the developing apparatus, use was made of an apparatus capable of passing 6,000 sheets of A4 size at a coverage rate of 5%, and the experiment was carried out with continuous sheet passing under an environment of 15° C. in which ghost is liable to be conspicuous.

As an image outputted onto a sheet, characters and a black pattern of 25 mm square were constituted on the leading edge portion of the sheet, and a pattern which was a halftone of a dot percentage of about 40% was constituted on that portion of the sheet corresponding to after one revolution of the developing sleeve from the leading edge portion of the sheet. Then, comparison was made about the manner in which the ghost image occurring in the halftone is conspicuous, and white haze and longitudinal streaks.

The judgment standard for image at this time is similar to that in Embodiment 1.

When the degree of circularity of the toner A shown in Table 2 is low, ghost is at a level Δ for the lubricant of Comparative Example 1, and ghost becomes good for the lubricant of Comparative Example 2, but white haze somewhat occurred. On the other hand, for the toner having a high degree of circularity, ghost was bad, and for the lubricant of Comparative Example 2, conversely white haze and longitudinal streaks occurred remarkably.

In contrast, in the lubricant (d) of the present embodiment, the occurrence of ghost, white haze and longitudinal streaks can be suppressed irrespective of the height of the degree of circularity of the toner, and the effect of the present invention is particularly great in the toner having a high degree of circularity for which ghost and white haze occurred remarkably.

TABLE 2

| | Y = 62 (The degree of circularity is low) | | Y = 78 (The degree of circularity is high) | |
|---|---|---|---|---|
| | negative ghost | white haze/ longitudinal streak | negative ghost | white haze/ longitudinal streak |
| Example (d) | ○ | ○ | ○ | ○ |
| Comparative Example 1 | Δ | ○ | X | ○ |
| Comparative Example 2 | ○ | Δ | ◎ | X |

In the case of the toner B shown in Table 3, negative ghost occurred strongly in the toner having a high degree of circularity for the lubricant of Comparative Example 1, as in the toner A. For the lubricant of Comparative Example 2, negative ghost was considerably improved, and although not so much as in the toner A, white haze and longitudinal streaks sometimes occurred. In contrast with these, in the lubricant (d) of the present embodiment, it has become possible to bring all of ghost, white haze and longitudinal streaks to a level free of problem.

TABLE 3

| | Y = 61 (The degree of circularity is low) | | Y = 76 (The degree of circularity is high) | |
|---|---|---|---|---|
| | negative ghost | white haze/ longitudinal streak | negative ghost | white haze/ longitudinal streak |
| Example (d) | ◎-○ | ○ | ○ | ○ |
| Comparative Example 1 | Δ | ○ | X | ○ |
| Comparative Example 2 | ○ | Δ | ○ | Δ-X |

As described above, in the present embodiment, by being combined with the toner having a high degree of circularity, the effect of the present invention could be displayed more sufficiently and images of a high quality could be obtained and also, ghost, white haze and longitudinal streaks which had posed a problem could be suppressed.

Embodiments 1 and 2 described above can be summarized as follows.

In Embodiments 1 and 2, attention is paid to the fact that the problem to be solved is the early stage of the use (the first half of the use) of the developing apparatus or the process cartridge, and as means for improving the developing property by the use of a lubricant, design is made so as to cause the lubricant to act as a microcarrier, thereby obtaining an effect against low density and negative ghost occurring at the early stage of the use of the apparatus.

As the lubricant, it is preferable to use specifically spherical polymer particles of a polarity opposite to that of the toner and sufficiently smaller than the weight average particle diameter of the toner. The toner is carried so as to contact with the polymer particles made to adhere onto the developing sleeve or the developing blade, whereby the polymer particles, because of being opposite in polarity to the toner, can act as a microcarrier, to thereby promote the charging of the toner.

Also, the polymer particles opposite in polarity to the toner should desirably be of a spherical shape having a degree of circularity of 0.90 or greater in order to obtain the role as a lubricant and the role as a microcarrier for the toner. This is because an amorphous shape would reduce the property of imparting charges to the toner.

Here, it has been found that in a developer relatively high in chargeability, for a lubricant consisting of only polymer particles of an opposite polarity, there is the tendency that there occur an area in which the toner is infinitesimally excessively charged and an area in which the toner is not so and therefore, to reduce the excessive charging, it is preferable to mix particles of a scalelike amorphous shape and of the same polarity as the toner with the above-described spherical particles.

By suitably mixing polymer particles of a polarity opposite to that of the toner and amorphous polymer particles of the same polarity as the toner together, it is possible to freely adjust the chargeability of the entire lubricant. Consequently, this is effective against ghost, and the charge amount of the lubricant can be set to such a degree as suppresses the occurrence of white haze and longitudinal streaks.

Also, the reason why the polymer particles of the same polarity as the toner should preferably be of a scalelike shape is that the charging among the spherical polymer particles of the opposite polarity is easy to uniformize in a lateral direction, and the charge amount of the spherical polymer particles of the opposite polarity becomes easy to suppress.

Also, the reason why the relation that (the weight average particle diameter of spherical polymer)<(the weight average particle diameter of amorphous polymer) is preferred is that the amorphous polymer particles act to uniformize the charge amount among a plurality of spherical polymer particles, and the set range within which ghost, white haze and longitudinal streaks can be suppressed can be secured widely.

The spherical polymer particles need have a weight average particle diameter of 0.01-3 μm to mitigate negative ghost, and it is preferable that the weight average particle diameter of the amorphous polymer particles which is effective to mitigate ghost and which can suppress white haze and longitudinal streaks be 1-6 μm. The reason why the upper limit of the weight average particle diameter of the amorphous polymer particles is 6 μm is that a size equal to or larger than the weight average particle diameter of the toner may affect the charging itself of the toner or may make the effect as the lubricant small.

Also, as the lubricant, it is preferable to select polymer particles conforming to the polarity of the toner. Irrespective of the shape of the toner used, the effect can be obtained, but it has been found that the effect is particularly great in the following toner.

The toner used is a toner of which the weight average particle diameter X is 5-12 μm and which has particles having a toner circle corresponding diameter of 3 μm or greater and having a degree of circularity of 0.900 or greater by 90% or more in terms of a cumulative value based on the particle number standard, and in which the relation between the particle number cumulative standard value Y of particles having a degree of circularity of 0.950 or greater and the weight average particle diameter X of the toner satisfies $$Y \geqq \exp 5.51 \times X^{-0.645} \quad (2)$$

where $5.0 < X \leqq 12.0$.

Such a toner having a high degree of circularity, as compared with the conventional toner of a distorted shape, differs in surface area relative to the same volume and therefore, becomes small in the charge amount by which it is charged, and particularly at the early stage of the use of the apparatus, the charge distribution is liable to become broad. Consequently, strong negative ghost is liable to occur at the early stage of the use of the apparatus.

In contrast, by selecting the lubricant described in Embodiments 1 and 2, there can be obtained a good image in which the effect for the prevention of negative ghost is great and the occurrence of white haze and longitudinal streaks are suppressed.

This application claims priority from Japanese Patent Application No. 2004-296756 filed on Oct. 8, 2004, which is hereby incorporated by reference herein.

What is claimed is:

1. A developing apparatus comprising:

a developer carrying member, which carries developer including toner;

a developer regulating member, which regulates a layer thickness of the developer carried on said developer carrying member; and a lubricant provided in a portion of contact between said developer carrying member and said developer regulating member with the developer being not present on said developer carrying member, said lubricant including a first polymer particle, which is of a spherical shape having an average degree of circularity of 0.90 or greater and is of a polarity opposite to a charging polarity of the toner, and a second polymer particle, which is of a scalelike shape and is of the same polarity as the charging polarity of the toner.

2. A developing apparatus according to claim 1, wherein said second polymer particle is amorphous.

3. A developing apparatus according to claim 1, wherein a weight average particle diameter of said first polymer particle is 0.01 to 3 μm, a weight average particle diameter of said second polymer particle is 1 to 6 μm, and a relation that the weight average particle diameter of said first polymer particle<the weight average particle diameter of said second polymer particle is satisfied.

4. A developing apparatus according to claim 1 or 3, wherein the toner has a weight average particle diameter of 5 to 12 μm, and has particles having a toner circle corresponding diameter of 3 μm or greater and having a degree of circularity of 0.900 or greater by 90% or more in terms of a cumulative value based on a particle number standard, and a relation between a particle number cumulative standard value Y and a toner weight average particle diameter X of particles having a degree of circularity of 0.950 or greater satisfies $$Y \geqq \exp 5.51 \times X^{-0.645}$$

where $5.0 < X \leqq 12.0$.

5. A developing apparatus according to claim 1, wherein said developing apparatus is detachably mountable to a main body of an image forming apparatus.

6. A developing apparatus according to claim 1, wherein said developing apparatus is detachably mountable to a main body of an image forming apparatus along with an image bearing member on which a developing operation is performed by said developing apparatus.

* * * * *